US005421373A

United States Patent [19]

Hacker et al.

[11] Patent Number: 5,421,373

[45] Date of Patent: Jun. 6, 1995

[54] APPARATUS FOR STAGGERING REED DENTS IN A SEAM WEAVING MACHINE

[75] Inventors: Hans-Eugen Hacker, Reutlingen; Edgar Hofstetter, Hohenstein, both of Germany

[73] Assignee: Novatech GmbH Siebe und Technologie fur Papier, Reutlingen, Germany

[21] Appl. No.: 110,963

[22] Filed: Aug. 24, 1993

[30] Foreign Application Priority Data

Aug. 24, 1992 [DE] Germany ..... 9211353 U

[51] Int. Cl.[6] ..... D03D 41/00; D03D 3/04

[52] U.S. Cl. ..... 139/192; 139/383 AA

[58] Field of Search ..... 139/383 AA, 189, 192, 139/191

[56] References Cited

U.S. PATENT DOCUMENTS 3,622,415 11/1971 Kunsman ..... 139/383 AA X
3,770,024 11/1973 Pfarrwaller ..... 139/189
4,359,501 11/1982 DiTullio ..... 139/420 A
4,410,015 10/1983 Koller .

FOREIGN PATENT DOCUMENTS 00434441 8/1981 European Pat. Off. .
0236601 2/1986 European Pat. Off. .
33040 11/1964 Germany .
2151579 10/1971 Germany .
3003277 8/1980 Germany .
8122448 7/1981 Germany .
9205834 5/1992 Germany .
680004 2/1989 Switzerland .

*Primary Examiner*—Andrew M. Falik
*Attorney, Agent, or Firm*—Sughrue, Mion, Zinn, Macpeak & Seas

[57] ABSTRACT

A support for the reed of a seam-weaving machine for joining the ends of a flat-woven, paper-making fabric by means of a woven seam includes a reed having reed dents for the shifting of the auxiliary weft threads against the fell. The reed dents are pivotally mounted and press successively against the auxiliary weft thread to be shifted starting from the fabric end from which the auxiliary weft threads protrude as a warp fringe. In order that the reed dents are gradually shifted by the movement of the sley, the reed dents are staggerable in their position such that the points at which the reed dents touch the auxiliary weft thread to be shifted lie roughly on a straight or slightly curved line whose distance from the fell increases, starting from the point of emergence of the auxiliary weft thread from the fabric end.

8 Claims, 5 Drawing Sheets

APPARATUS FOR STAGGERING REED DENTS IN A SEAM WEAVING MACHINE

BACKGROUND OF THE INVENTION

The present invention relates to a support for the reed of a seam-weaving machine for joining the two ends of a plastics fabric by means of a woven seam. The reed has reed dents for shifting auxiliary weft threads against the fell of the fabric, the reed dents being pivotally mounted and, starting from the fabric end at which the auxiliary weft thread to be shifted in each case protrudes as a warp fringe, pressing successively against the auxiliary warp thread to be shifted.

Industrial plastic fabrics for uses in which an absolutely regular surface structure of the fabric is required, especially in the case of flat-woven plastic paper-forming fabrics, are made continuous by a woven seam. To produce a woven seam, warp threads are exposed to a length of e.g. 15 cm at the fabric ends which are to be joined to each other, the weft threads in this zone being removed. The so-called woven seam, in which the original weave binding is exactly reproduced, is formed from these warp thread fringes and the weft threads removed from the fabric. An auxiliary weaving shed or seam-weaving shed is spread out from the removed weft threads, the removed weft threads functioning as auxiliary warp threads. The warp thread fringes are inserted into this auxiliary weaving shed as auxiliary weft threads alternately from the two fabric ends. The warp thread fringes, i.e. the auxiliary weft threads, and the removed weft threads, i.e. the auxiliary warp threads, are as a rule monofilaments with a diameter of 0.1 to 0.5 mm and the woven seam is manufactured after the thermosetting of the fabric, so that the threads already have the corrugation or knuckle corresponding to the weave binding in question. To obtain a woven seam which has a high tensile strength and does not differ from the rest of the fabric in the patterning of the surface which is decisive for the marking in the paper, the auxiliary warp threads and the auxiliary weft threads must interweave with their knuckles in the fabric, so that a form-locking results. The interweaving of the auxiliary warp threads and auxiliary weft threads according to their knuckle is achieved inter alia because the reed does not shift the auxiliary weft threads simultaneously along the whole length, but the auxiliary weft threads are progressively shifted through the seam-weaving shed, starting from their point of emergence from the fabric end.

A reed which permits such a gradual shifting of the auxiliary weft threads is described in DE-U-81 22 448. The reed is movable into an operating position brought close to the fell. The reed dents pivotally mount on a shaft are kept back away from the fell by a rubber strip. Starting from the fabric end, they are pressed one after another against the auxiliary weft thread by a deflection member, against the elasticity of the rubber strip. The deflection member is a roller displaceable on a guide track and the roller is pushed along the reed dents over the whole seam width for every shifting process.

The same object is achieved according to EP-A-0 043 441 by a rotatably needle roller which has a plurality of flexibly elastic needles which are arranged in helical rows of needles. Also described as a further possibility in this publication is the shifting of the auxiliary weft threads by means of Z-shaped needles which are arranged in a guide bed alongside each other and individually axially displaceable. The needles engage in the shed with their front Z-end. The Z-shaped needles are pushed one after another against the fell by means of a coulisse so that the auxiliary weft thread is progressively shifted in a wave motion, starting from its point of emergence from the fabric end.

SUMMARY OF THE INVENTION

The object of the present invention is to accelerate the seam-weaving process. According to the invention, this object is achieved in that the support for the reed dents of a reed of the type mentioned initially is designed in such a way that the reed dents are so offset or staggered relative to each other upon the forward shifting of the sley that the points at which the individual reed dents touch the auxiliary weft thread to be shifted lie on a straight or slightly curved line whose distance from the fell constantly increases, starting from the point of emergence of the auxiliary weft threads from the fabric end.

The weaving cycle is shortened as a result. The period of time previously required for the successive impingement of the reed dents by means of the through-passing actuation roller, by means of the rotating needle roller or through the displacement of the Z-needles, ceases to apply. Through the staggering of the reed dents along a straight or slightly curved line running inclined to the fell, the movement of the sley is enough to shift the auxiliary weft thread gradually out from the fabric, starting from its outlet end from the fabric.

The reed is preferably so designed that the reed dents have at their lower end an opening with which they are strung together on a shaft. At their lower end, the reed dents can also be widened to form a foot. The end of the foot facing away from the fell rests on a rubber strip, while the end of the foot facing the fell sits on a base strip. The base strip and he rubber strip are arranged on opposed sides as regards the longitudinal direction of the reed dents, so that they exert opposed torsional moments on the reed dents. The reed dents are pressed yieldingly forwards, i.e. to the fell, by the rubber strip. The forward position of the individual reed dents is fixed by the base strip which is rigid in itself. The base strip is tiltable somewhat towards one fabric end and towards the other fabric end by an adjustment device. The tilt axis lies parallel to the direction of the auxiliary warp threads and expediently lies in the center of the base strip. Depending on the position of the base strip, the individual reed dents move towards or away from the fell. The reed formed from the totality of the reed dents can therefore be set at an inclination to the fell by a tilting of the base strip.

The inclined reed is shifted with the sley towards the fell. The outermost reed dent on the side near the point of emergence of the warp fringe from the fabric end is the first to touch the fell and shifts this warp thread fringe as an auxiliary weft thread, the latter snapping as a result of its fixed corrugation between the auxiliary warp threads which likewise contain a fixed corrugation. As a result of the further forward movement of the sley, the individual reed dents press one after another against the auxiliary weft thread until the latter is shifted over its whole length or as far as the so-called splice point, where it leaves the fabric above or below. The reed dents already in contact with the auxiliary weft thread are pressed more strongly against the rubber strip upon the further movement of the sley and lift away from tile base strip. The gradual shifting of the auxiliary weft thread occurs in a very short time, namely within the period of time which the sley needs to travel through the angle by which the last reed dent is offset relative to the first reed dent.

After the shifting of an auxiliary weft thread from the one fabric side, the base strip is reversed and tilted onto the other side, so that the staggering of the reed dents is inverted and an auxiliary weft thread which emerges from the fabric end can now be shifted.

Of particular advantage with this staggering of the reed dents is the fact that these move parallel to the auxiliary warp threads and therefore, most favorable preconditions for the shifting of the auxiliary weft threads are obtained even in the case of very dense fabrics. Up to about five auxiliary warp threads can run between two reed dents. Another advantage of the invention is that only a minimal mass, namely that of the reed dents, is to be accelerated during the shifting, and a very rapid sley movement toward the fell is therefore possible.

As a rule, the fell behaves in such a way that it is concave when a woven seam is begun and then convex as the woven seam process progresses. Thus the fell does not generally run in a straight line. It is advantageous to match the shape of the reed, i.e. the arrangement of the reed dents, to the shape of the fell. There are several possible ways of doing this so that the reed dents will be staggered relative to each other.

Firstly, the shaft on which the reed dents are strung together can be curved. Through rotation of the shaft, the reed dent feet will be raised or lowered according to the curvature of the shaft relative to the rubber strip and base strip and thereby pivoted somewhat towards the fell or away from it. This pivotal movement is most pronounced in the central zone of the reed and decreases towards the lateral end-zones. It is then possible, through rotation of the shaft, to match the arrangement of the reed dents to the curvature of the fell as this changes in the course of the seam-weaving process.

Secondly, the shaft on which the reed dents are strung together can be selectively bent by adjustment devices, e.g. hydraulic cylinders, which engage at the axis via intermediate members, and thereby matched to the curvature of the fell. Ultimately, the same effect is thus achieved as with the first possibility described above. In both cases it is advisable to design the housing of the shaft in the bearing supports as a ball-and-socket joint in order to obtain a bending line of the axis starting from the bearing supports. In this way, account is best taken of the curvature of the fell.

Finally, another possibility is to curve the base strip and optionally also the rubber strip. This can take place e.g. if the base strip is tiltable as described above about a tilt axis running through its center and adjustment devices are provided at each end of the base strip.

During the manufacture of a woven seam, the fabric ends to be joined are fixed in a frame and the seam-weaving machine is pushed in this frame along the fabric ends. The advance of the seam-weaving machine can also be triggered according to a preferred version of the invention by a downwardly extended reed dent. As the woven seam progresses, the fell migrates in the direction of the sley and as a result, the reed dents at the forward dead point of the sley are pressed more strongly against the rubber strip. The extended lower end of the reed dent is thus also more markedly swivelled and reaches a switch which transmits a signal to the control system for the further movement of the seam-weaving machine.

BRIEF DESCRIPTION OF THE DRAWINGS

An embodiment of the invention is described below with reference to the drawings wherein.

DETAILED DESCRIPTION OF THE INVENTION

Figure 1:
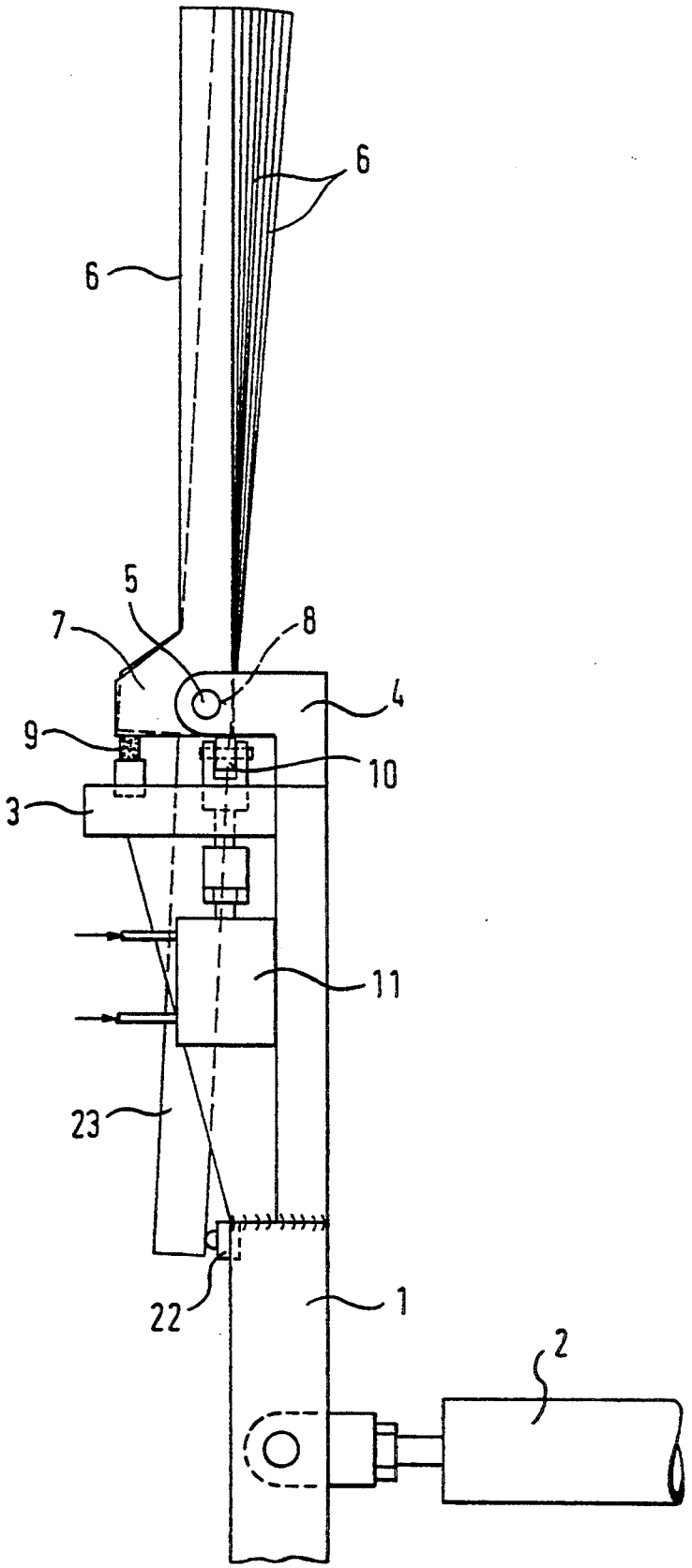
FIG. 1 is a side elevational view of the upper part of a sley and the reed i.e. in the direction of the auxiliary weft threads.
Figure 2:
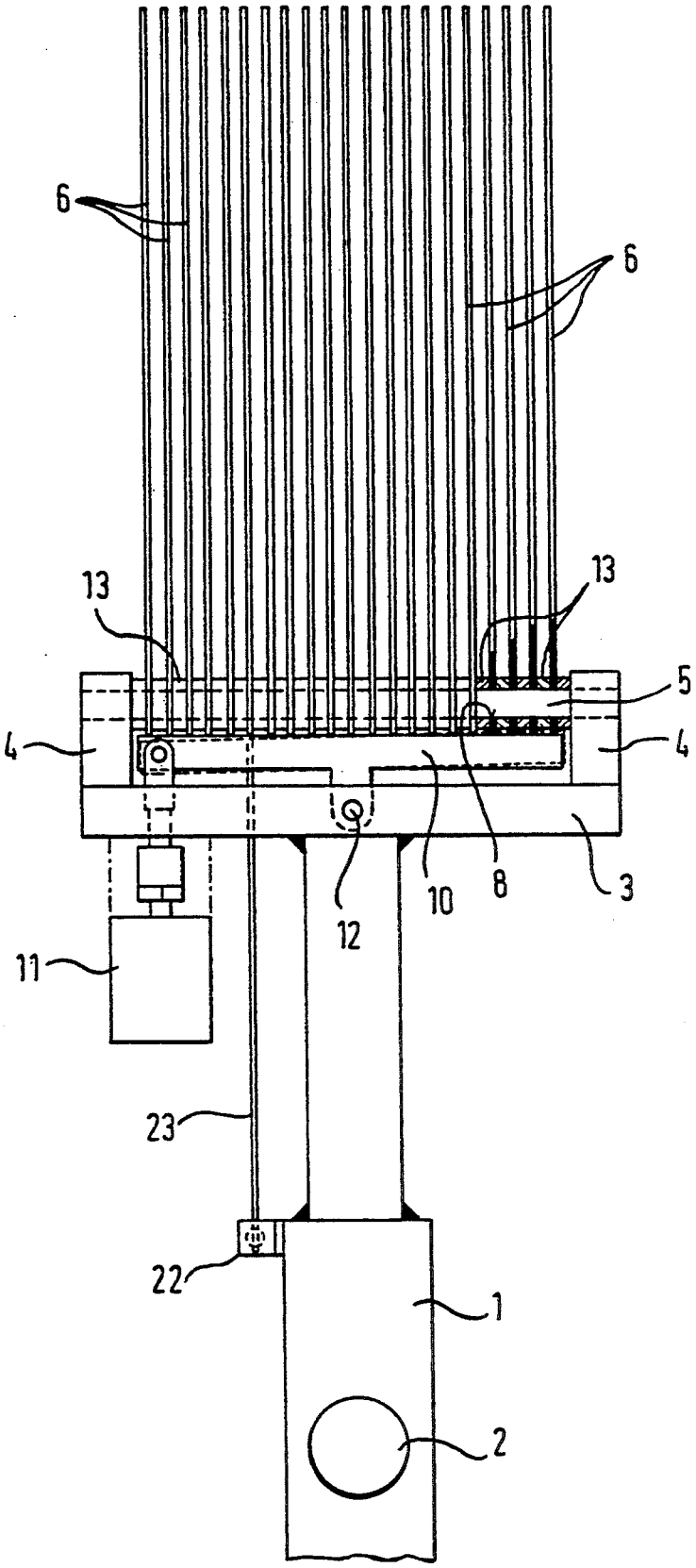
FIG. 2 is a front elevational view of the upper part of the sley and the reed as shown in FIG. 1, i.e. in the direction of the auxiliary warp threads.

Shown in FIGS. 1 and 2 is the upper end of a sley 1 which is pivotable in the usual way by a sley-drive cylinder 2. At the upper end, the sley 1 has a crossarm 3 from whose lateral ends there project upwardly bearing supports 4 in which a shaft 5 is removably secured. Reed dents 6 are arranged on the shaft 5. At the lower end, the reed dents 6 have a bore 8 in which they are strung together on the shaft 5. They are kept, by spacing rings 13 lying there between, at a distance which is preset by the thread count of the fabric. The reed dents 5 are widened in the form of a foot at the lower end and rest with the end of the foot remote from the shaft 5 on a rubber strip 9. The opposite end of the foot 7 near the shaft rests on a base strip 10. The arrangement is such that the rubber strip 9 and the base strip 10 exert opposed torsional moments on the reed dents 6 and thereby fix their position. The individual reed dents 6 are pressed against the base strip 10 by the elastic force of the rubber strip 9. The rubber strip 9 is arranged in a fixed position on the crossarm 3, while the base strip 10 is tiltable about a pivot point 12 which lies in the center of the base strip 10 in the embodiment shown, but which can also lie at one of the two ends. The rotation axis 12 lies horizontal in the direction of the movement of the sley 1. The base strip 10 can be tilted by an electric, mechanical, pneumatic and similar adjustment device, e.g. by an adjustment cylinder 11. Through the tilting of the base strip 10, the individual reed dents 6 are pivoted at varying distances towards the fell and away from it and pressed with varying force against the rubber strip 9 to stagger the reed dents relative to each other.

In FIG. 2, the base strip 10 is shown with solid lines in its central position in which all reed dents are the same distance from the fell. The base strip 10 is shown with broken lines in one of its tilted positions, in which the reed dents 6 on the left in FIG. 2 are pivoted towards the observer, i.e. towards the fell.

Figure 4:
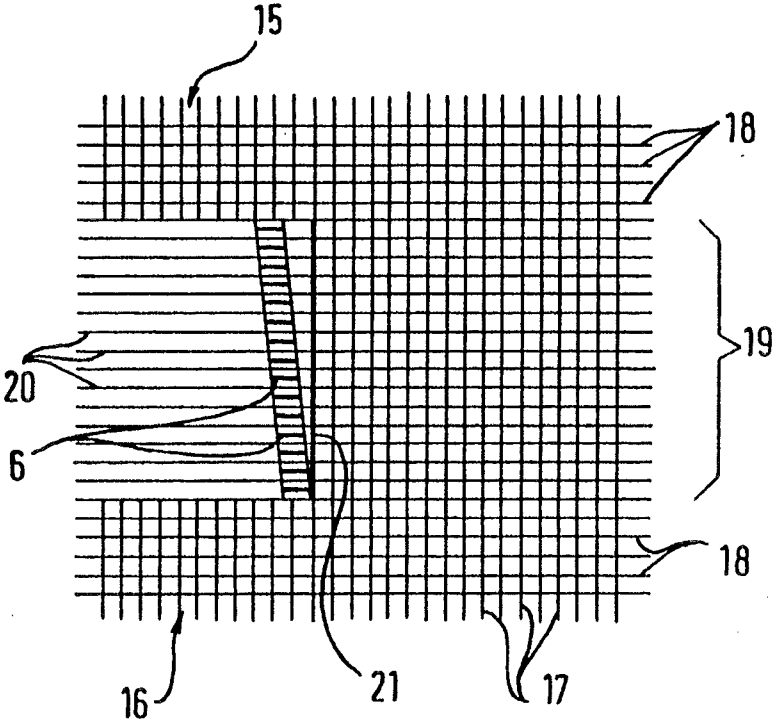
FIG. 4 is a view similar to that of FIG. 3 but upon the shifting of an auxiliary weft thread from the other side.
Figure 3:
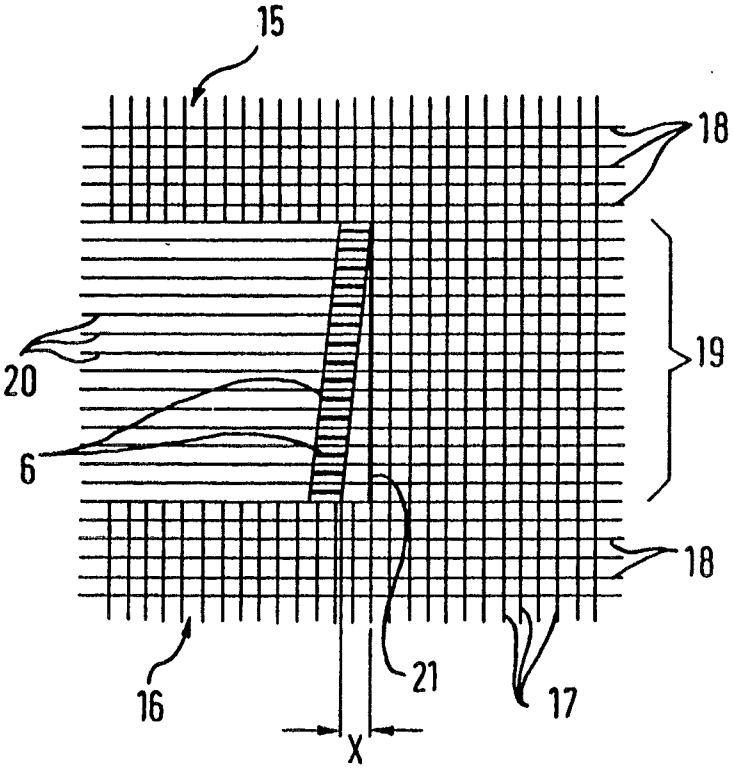
FIG. 3 is a diagrammatic representation of the reed from above at the moment when the first reed dent touches the fell upon the movement of an auxiliary weft thread from one side.

FIGS. 3 and 4 show in simplified form the position of the reed and of the individual reed dents 6 upon the shifting of auxiliary weft threads. The fabric ends 15, 16 consist of warp threads 17 and weft threads 18 and the fabric ends 15, 16 are, in the representation of FIGS. 3 and 4, already partly connected by a woven seam 19. In the part which is not yet connected, only the auxiliary warp threads 20 are represented, while the warp thread fringes emerging from the fabric end have been omitted for the sake of clarity. FIG. 3 shows the position of the reed for the shifting of an auxiliary weft thread emerging from the upper fabric end 15, seen in FIG. 3. At this fabric end 15, the reed dents 6 are therefore at their smallest distance from the fell 21, so that the auxiliary weft thread, starting from this fabric end 15, is progressively shifted over the width of the woven seam 10. This progressive shifting takes place within a very short time, namely within the period which the sley-drive cylinder 2 needs to pass through the section X shown in FIG. 3. At the front dead point of the movement of the sley 1, the initially dominant reed dents 6, i.e. those reed dents which are the first to touch the fell, are lifted off from the base strip 10, the lifting path being absorbed by the elasticity of the rubber strip 9.

After the beating, i.e. after the complete shifting of an auxiliary weft thread, the base strip 10 is reversed in each case, with the result that the auxiliary weft threads can be inserted alternately from the fabric sides 15 and 16. FIG. 4 shows the position of the reed dents 6 at the beginning of the insertion of a warp thread fringe emerging from fabric end 16 as an auxiliary weft thread.

The central reed dent 23 is extended downwards and can actuate a switch 22. During the manufacture of the woven seam, the fabric ends 15, 16 are firmly clamped as usual and the seam-weaving machine is pushed along the fabric ends 15, 16. The shifting of the seam-weaving machine can be triggered by the switch 22. As a result of the progress of the woven seam, the reed dents 6 beat earlier against the fell and are pressed more strongly against the rubber strip 9 and accordingly, seen in FIG. 1, are pivoted further anticlockwise. With the corresponding progress of the woven seam, the extension of central reed dent 23 then touches the switch 22, which emits a signal for the further movement of the seam-weaving machine by one step.

Figure 6:
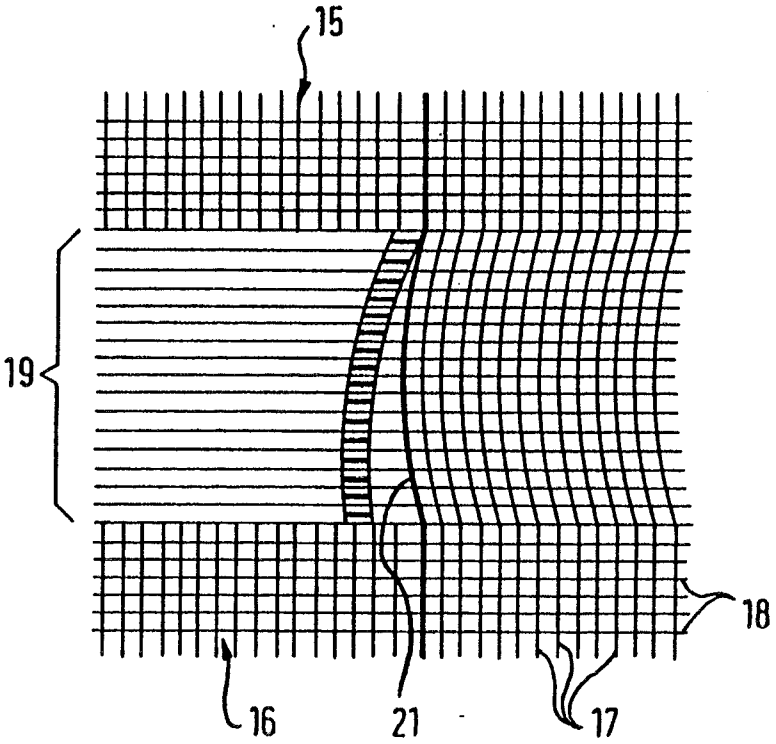
FIG. 6 is a representation similar to that of FIG. 5 in which the convex curvature of the woven seam at the end of the seam-weaving process can be seen.
Figure 5:
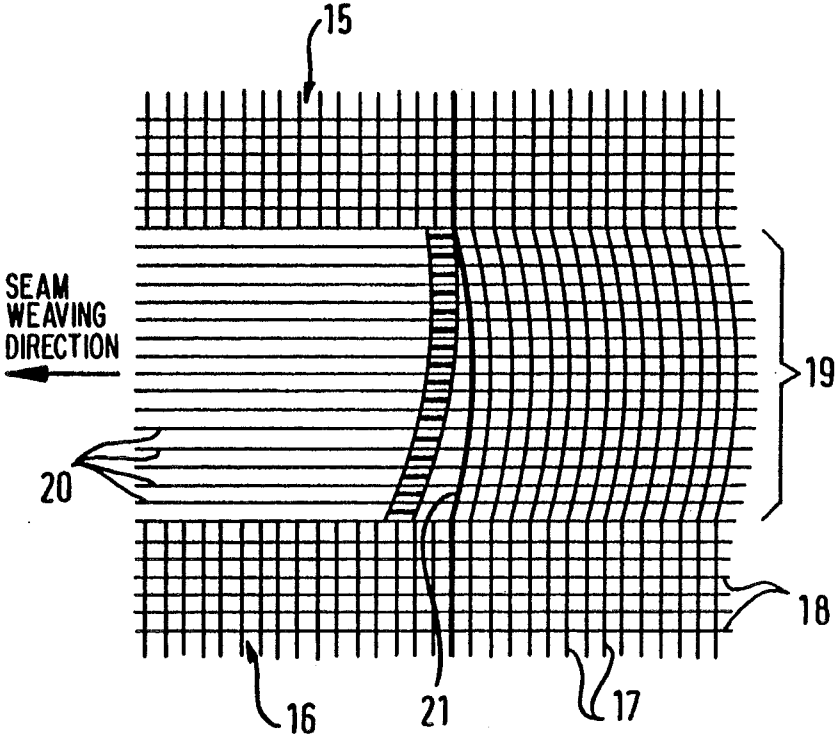
FIG. 5 is a view similar to that of FIG. 3 in which the concave curvature of the woven seam at the beginning of the seam-weaving process can be seen.

FIGS. 5 and 6 are a representation similar to that of FIG. 3. FIG. 5 showing the concave curvature of the woven seam at the beginning of the seam-weaving process. In the course of the seam-weaving process, the fell 21 then follows a straight course which becomes convex towards the end of the seam-weaving process, as is shown in FIG. 6. As with the embodiment of FIG. 3, the distance of the reed dents from the fell increases uniformly from fabric end 15 to fabric end 16, but the reed dents 6 lie, not on a straight line, but on a line curved according to the course of the fell 21. The result of this is that the individual reed dents shift the auxiliary weft threads in chronological succession, despite the curved course of the fell 21, with about the same force.

Figure 7:
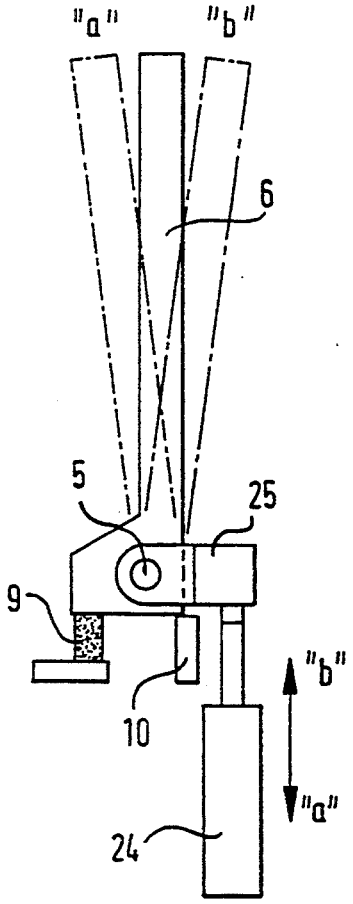
FIG. 7 is a side elevational view of another embodiment of the apparatus at the sley for achieving a curved shape of the reed.
Figure 8:
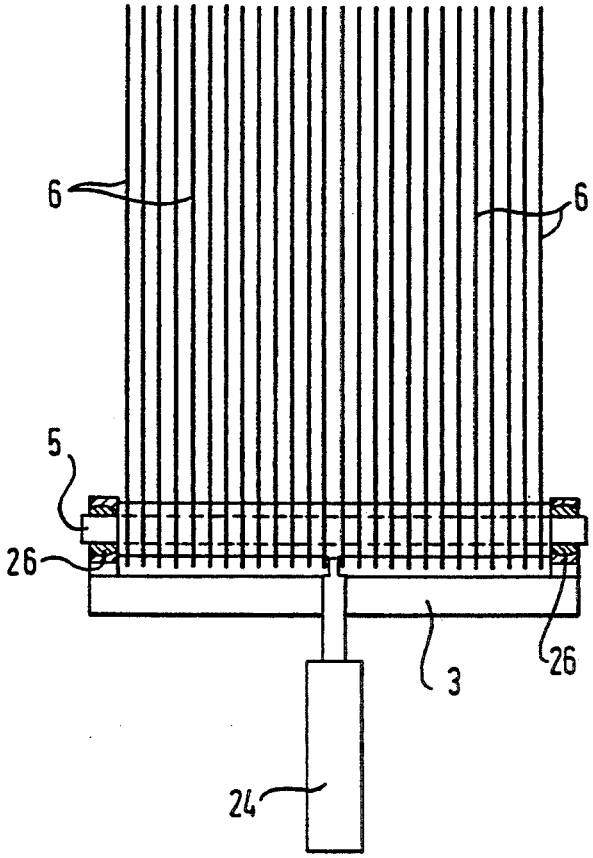
FIG. 8 is a front elevational view of the embodiment of FIG. 7.

FIGS. 7 and 8 show an embodiment similar to that of FIGS. 2 and 2, but with an additional means for arranging the reed dents 6 on a curved line, the curvature being adjustable, with the result that the shape of the reed can be matched to the course of the fell as this changes during the seam-weaving process. An additional cylinder 24 engages a crossarm 25 in the center of the shaft 5 and directs this upwards or downwards, with the result that the shaft 5 is given an upwardly or downwardly bent course. This cross arm 25 should, at the point of engagement of the shaft 5, have roughly the thickness of the spacing ring replaced there by the crossarm 25, in order that the reed dent distance is also maintained at this point. If the shaft 5 is bent downwards, the consequence is that the reed dents 6 are pivoted somewhat away from the fell as seen at "a" in FIG. 7 with reed dents in the central zone of the shaft 5 more markedly pivoted than the reed dents arranged further out. The rubber strip 9 keeps the reed dents 6 stressed despite their different positions. The points at which the reed dents 6 touch the auxiliary weft thread to be shifted thus lie on a convex line bent away from the fell 21, as in shown in FIG. 5, if the cylinder 24 deflects the shaft 5 downwards. Conversely, the reed dents 6 arrange themselves on the concave line shown in FIG. 6 is the cylinder 24 deflect the shaft 5 upwards as seen at "b" in FIG. 7. Because of the leverage which results from the length of the reed dents 6 compared with the distance of the central point of the shaft from the base strip 10, only a slight stroke change of the cylinder 24 is needed to produce a convex or concave shape of the reed. To achieve as uniform as possible a bending of the shaft 5, its ends expediently rest in ball-and-socket joints 26. The same result can also be achieved by using a shaft 5 which is bent in itself and is rotated by a servomotor so that the deflection of the shaft 5 can be directed upwards or downwards. Any intermediate position is naturally also possible, a straight reed resulting if the deflection of the shaft 5 lies in the horizontal.

While the invention has been particularly shown and described with reference to preferred embodiments thereof, it will be understood by those in the art that the foregoing and other changes in form and details may be made therein without departing from the spirit and scope of the invention.

What is claimed is:

1. A sley for a seam-weaving machine for joining first and second opposite ends of a fabric by means of a woven seam wherein each end has a plurality of auxiliary weft threads protruding as a warp fringe, said sley being adapted to be pivotally mounted on the machine and including a reed comprised of a plurality of reed dents for shifting each auxiliary weft thread against a fell of the woven seam, pivot means for pivotally mounting said reed dents on said sley for successive pressing against an auxiliary weft thread to be shifted, and means for staggering said reed dents relative to each other prior to shifting said sley toward said fell, each reed dent having a point which is adapted to touch the auxiliary weft thread to be shifted with each of said points lying substantially on a line whose distance from the fell constantly increases starting from a point of emergence of the auxiliary weft thread from the first fabric end.

2. A sley according to claim 1, wherein said pivot means is comprised of a shaft mounted on said sley and each reed dent having a bore in a lower end thereof through which said shaft extends and further comprising a plurality of spacing rings interposed between respective reed dents.

3. A sley as set forth in claim 2, wherein said reed dents are wider at the lower end thereof to define a foot having first and second ends and further comprising a rubber strip underlying and engaging said first end of each reed dent and a base strip underlying and supporting said second end.

4. A sley as set forth in claim 3, wherein said base strip is tiltable by an adjustment device about a horizontal axis extending in the direction of movement of said sley for inverting the staggering of the reed dents so that the touch points of the reed dents lie substantially on a line whose distance from the fell constantly increases from a point of emergence of the auxiliary weft thread from the second fabric end.

5. A sley as set forth in claim 2, wherein said shaft has a curved configuration from one end of the shaft to another and drive means are connected to said shaft for rotation of the shaft whereby said line can be provided with one of a concave, straight and convex shape.

6. A sley as set forth in claim 2, further comprising adjusting means for engaging said shaft to elastically bend the shaft whereby said line may be provided with one of a concave, a straight and a convex shape.

7. A sley as set forth in claim 5, further comprising ball-and-socket means for supporting opposite ends of said shaft.

8. A sley as set forth in claim 1, wherein at least one reed dent extends downwardly a substantial distance below said shaft for engagement with a switch mounted on said machine to indicate a need for further movement of the seam-weaving machine.

* * * * *